US006675482B1

(12) United States Patent
Gilbert, Jr. et al.

(10) Patent No.: US 6,675,482 B1
(45) Date of Patent: Jan. 13, 2004

(54) FEEDING SPOON

(76) Inventors: Lloyd A. Gilbert, Jr., 3502 176th Pl. SW., Lynnwood, WA (US) 98037; Mark S. Hanna, 5343 E. 4th St., Tulsa, OK (US) 74135

( * ) Notice: Subject to any disclaimer, the term of this patent is extended or adjusted under 35 U.S.C. 154(b) by 0 days.

(21) Appl. No.: 10/325,681

(22) Filed: Dec. 20, 2002

Related U.S. Application Data

(62) Division of application No. 09/925,756, filed on Aug. 9, 2001, now abandoned.

(51) Int. Cl.[7] ..... A61J 7/00

(52) U.S. Cl. ..... 30/141; 30/125; 222/258; D7/653; D24/198

(58) Field of Search ..... 30/125, 141, 123.3; 215/11.1; D7/653; D24/197, 198; 222/527, 528

(56) References Cited

U.S. PATENT DOCUMENTS 2,252,119 A * 8/1941 Edmonds ..... 30/123.3
2,837,822 A * 6/1958 Wille ..... 30/125
3,243,069 A * 3/1966 Duerme ..... 215/11.1
3,259,132 A * 7/1966 Katter ..... 30/141
3,473,221 A * 10/1969 Flanders ..... 30/141
D225,583 S * 12/1972 Lara ..... D7/653
D232,905 S * 9/1974 Bailenson ..... D24/197
D349,770 S * 8/1994 Jarnagin ..... D7/653
5,491,895 A * 2/1996 Lee ..... 30/125
6,264,074 B1 * 7/2001 Emilsson ..... 30/141

* cited by examiner

*Primary Examiner*—Hwei-Siu Payer
(74) *Attorney, Agent, or Firm*—Fellers, Snider, Blankenship, Bailey & Tippens, P.C.

(57) ABSTRACT

A feeding system comprising a spoon body having a concave feeding portion surrounded by an upper elliptical edge, a longitudinal handle having a pair of opposite ends, one end of the handle being attached to the spoon body and the other end of the handle constituting a first connector, and a compressible reservoir adapted to contain a predetermined quantity of food therein and having a second connector thereon engageable with the first connector, a passageway extending from the concave portion of the spoon body longitudinally through the handle and to the first connector so as to provide fluid communication between the spoon body and the reservoir, whereby, upon application of compressive force in said reservoir, a portion of the food is forced through the connectors, through the passageway, and into the interior of the spoon body.

3 Claims, 4 Drawing Sheets

FEEDING SPOON

CROSS REFERENCE TO RELATED APPLICATION

This application is a divisional of U.S. application Ser. No. 09/925,756 filed on Aug. 9, 2001 now abandoned.

BACKGROUND OF THE INVENTION

1. Field of the Invention

This invention relates generally to spoons designed for feeding infants and invalids. More particularly, but not way of limitation, the present invention relates to a spoon body which can be attached to a compressible reservoir such as a closed tube or syringe for feeding predetermined quantities of food or medication from the compressible reservoir into the spoon body for consumption by the infant or invalid.

2. Background

Spoons are obviously well known in the art. Many proposals have been put forth in the past for the purpose of dispensing predetermined quantities of food, medication or other beverage or soft solid to a consumer who might be an infant or an invalid. However, the art does not teach attaching a compressible reservoir, containing a predetermined quantity of liquid or semi-liquid material to be dispensed through a longitudinal axis into the spoon.

SUMMARY OF THE INVENTION

The present invention provides a feeding spoon consisting essentially of a spoon body and an attached compressible reservoir such as a flexible closed tube, possibly of plastic material, or a syringe which would have a plunger and graduations on the side of the syringe to indicate predetermined amounts to be dispensed to the spoon body. The "spoon" portion of the spoon body looks quite similar to the conventional spoon; however the handle of the spoon body is quite different in that it contains a longitudinal passageway which communicates with the interior surface of the spoon, and in that it also extends rearwardly away from the spoon body into a threaded adaptor which can be connected to the discharge end of a tube or syringe.

Reference to a "tube" means the conventional closed end tube which is generally sealed at the bottom by crimping, fusion or other method which closes the bottom in a liquid tight manner, and which has an upper threaded opening of reduced size which is closed by a threaded cap. Such tubes can contain tooth paste or medications such as ointments or salves. Obviously, the tube which is attached to the spoon body in the present invention can contain a predetermined quantity of liquid or semi-liquid material, especially some type of food or medication, which would be fed to an infant or invalid. Similarly, the syringe, when attached to the adaptor on the spoon, can dispense predetermined quantities of liquid into the spoon for the simple reason that the graduations on the body of the syringe will make it evident how much material has been dispensed into the spoon.

Other objects, features and advantages of the present invention will be apparent to those skilled in the art upon examining the accompanying drawings and upon reading the following description of the preferred embodiments.

DETAILED DESCRIPTION OF THE PREFERRED EMBODIMENT

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 1:
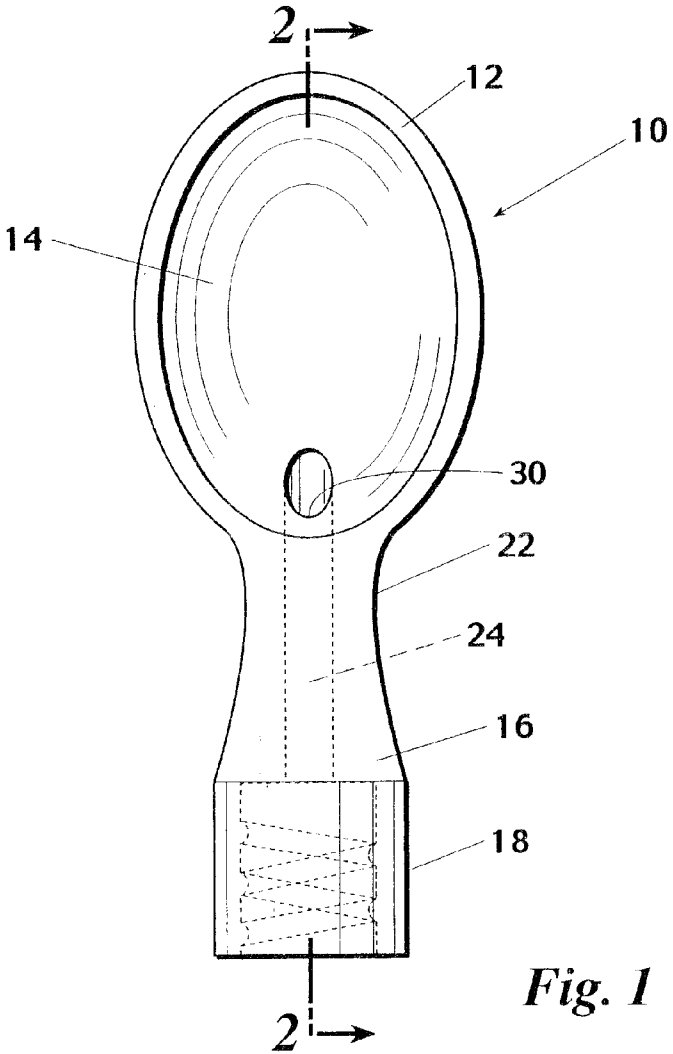
FIG. 1 is a plan view of the spoon or spoon body itself.
Figure 2:
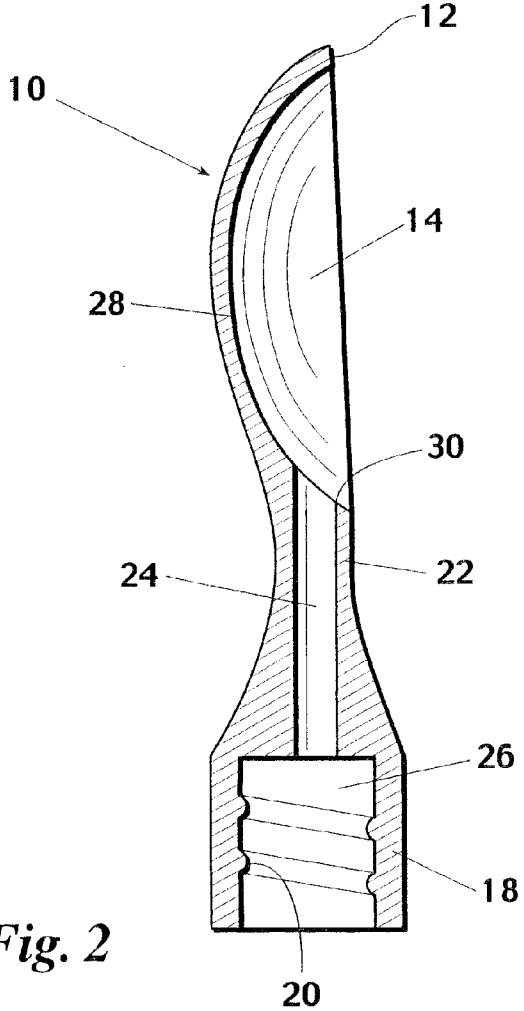
FIG. 2 is a longitudinal cross-section of the spoon taken along section line 2—2 of FIG. 1.

Referring to the drawings, a preferred embodiment of the invention is represented by a spoon body 10 having an elliptical rim or edge 12 at the top of a concave bowl or cavity 14 which represents the "spoon" portion of the spoon body and which is generally in the shape of one half of an oblate spheroid. The upper "spoon" portion 14 of the spoon body 10 shown in FIG. 1 is shaped similar to a conventional teaspoon; however the spoon body 10 of FIG. 1 is not provided with a conventional handle. To the contrary, the spoon body 10 of FIGS. 1 and 2 is provided with a short longitudinal handle 16 which terminates in a cylindrical portion 18 having internal threads 20 and constituting a first connector. The cylindrical portion 18 connects with the spoon body through a portion of reduced diameter 22. A longitudinal passageway 24 communicates with the center of a cavity 26 in which the threads 20 reside. The passageway 24 is preferably circular in cross-section.

As best seen in FIG. 2, the bottom surface 28 of the bowl 14 is concave in shape. The passageway 24 also communicates with the surface 28 through an opening 30 which appears to be oval in shape in FIG. 1.

Figure 3:
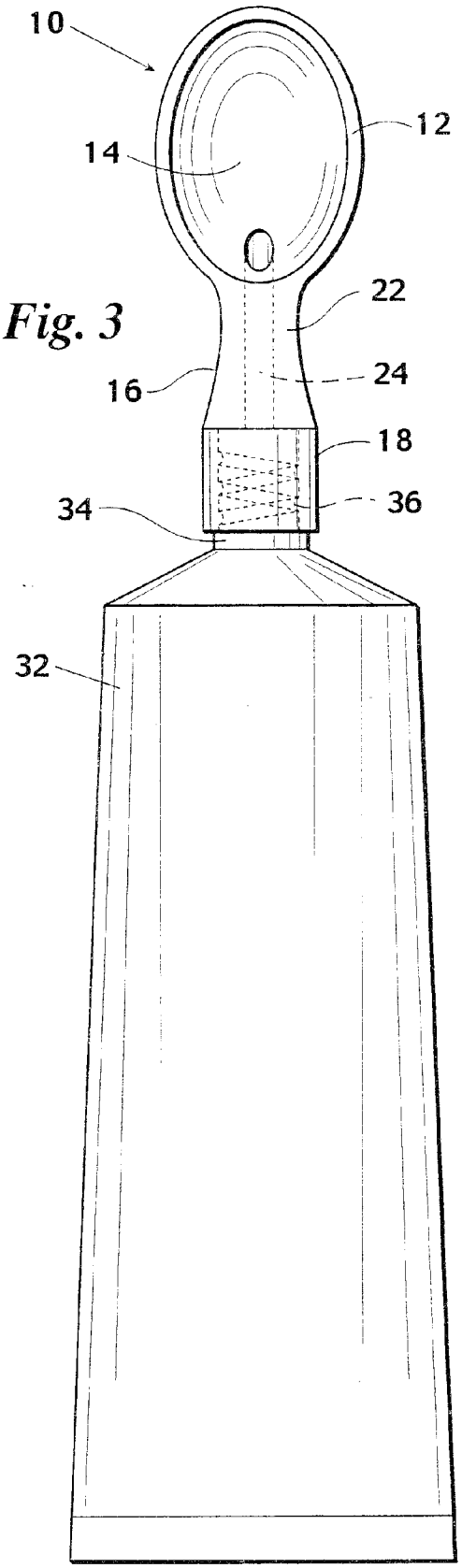
FIG. 3 is a plan view of the spoon of FIG. 1 showing its attachment to a tube for dispensing liquid or semi-liquid into the spoon.

Turning now to FIG. 3, there is shown a compressible reservoir consisting of a closed end tube 32 which connects with the handle 16 of the spoon body 10. The tube 32 is a conventional closed tube made of plastic or metal and is designed to contain a predetermined quantity of liquid or semi-liquid material such as food or medication. The upper open end of the tube 32 is provided with a conventional reduced cylindrical portion 34 which has external threads 36 thereon and which would otherwise be closed by a conventional threaded cap (not shown). For the purposes of the present invention the cylindrical portion 34 constitutes a second connector (boss) which interfits with and connects with the first connector 18 at the end of the handle 16. The threads 36 on the second connector 34 interact with the threads 20 (FIG. 2) on the cylindrical portion or first connector 18 so that the tube 32 can be screwed into or out of the cylindrical portion 18. When the arrangement of FIG. 3 is presented to an infant or an invalid, the tube 32 can be squeezed or compressed so that material inside the tube 32 will pass through the passageway 24 and into the cavity 14 on the spoon body. Depending on how much the infant or invalid wishes to consume, or is supposed to consume, more than one tube 32 can be provided, under which circumstances the tube shown in FIG. 3 can be removed and another placed in its stead.

Figure 4:
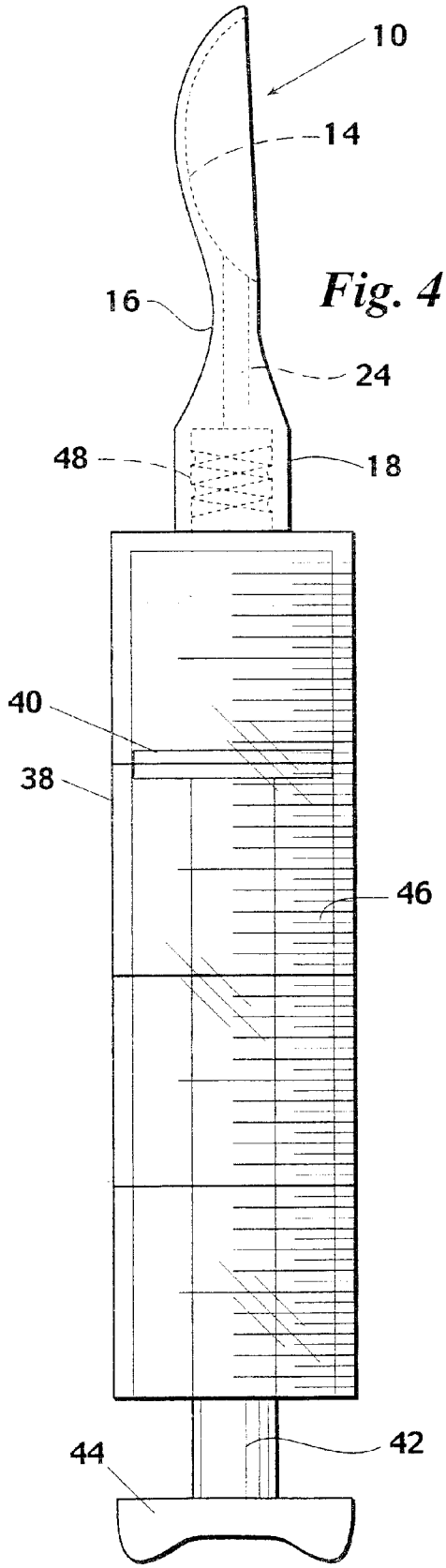
FIG. 4 is a side elevation view of the spoon showing its attachment to a syringe.

Referring now to FIG. 4, as an alternative to the flexible tube 32, it is contemplated that the flexible reservoir might be a conventional syringe 38. The syringe 38 can be provided with a plunger 40 which fills the cross-sectional shape of the interior of the syringe and which is attached to a rod 42 that extends outwardly to an external handle 44. The syringe 38 may also be provided with graduations 46 on the exterior of the syringe so as to provide an indication of the amount of food or medication which is dispensed into the spoon body after pushing on the handle 44. The upper end of the syringe 38 is provided with a conventional threaded boss 48 which is the equivalent of threaded upper end 34 (second connector FIG. 3) of the tube 32 shown in FIG. 3. The boss 48 constitutes a second connector which cooperates with the first connector 18 in the same manner as the second connector 34 cooperates with the first connector.

Pushing on the handle 44 will cause the piston 40 to move upwardly in the interior of the syringe 38 so as to exert a compressive force so as to cause liquid or other semi-solid material to pass through the passageway 24 and into the interior 14 of the spoon body.

Figure 5:
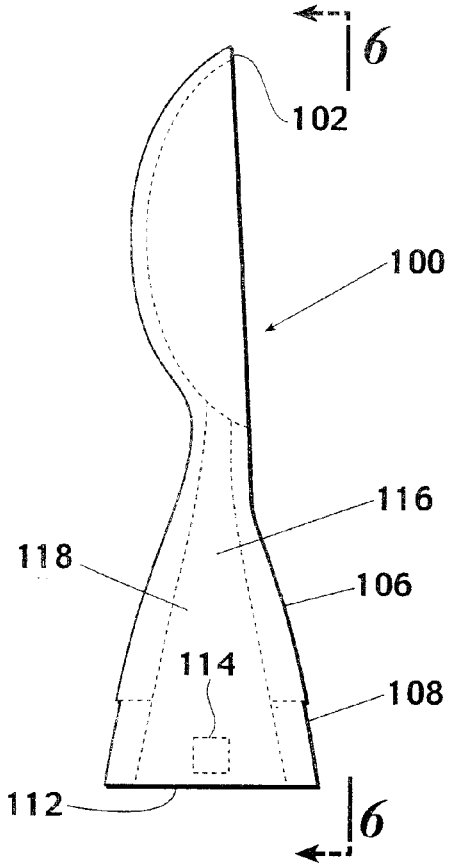
FIG. 5 is a side elevation view of an alternate preferred embodiment of the spoon.
Figure 6:
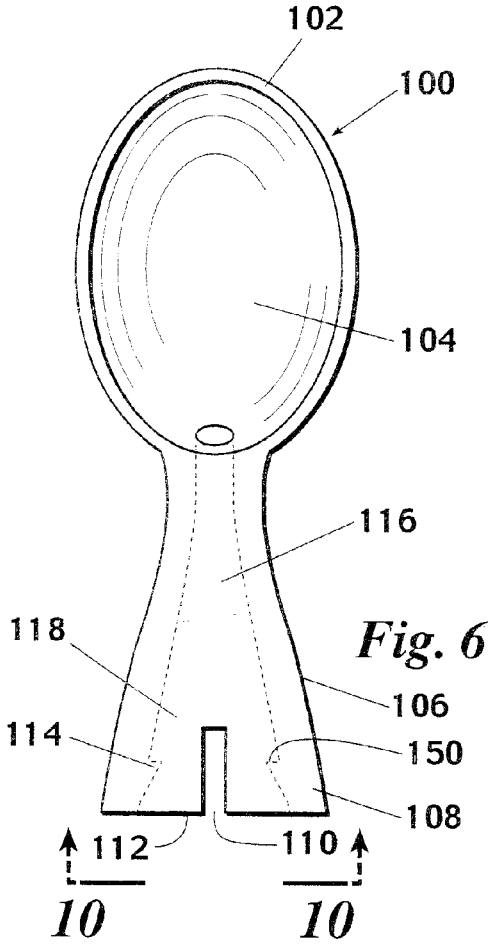
FIG. 6 is an elevation view of the spoon as seen from perspective 6—6 of FIG. 5.

In another preferred embodiment, as shown in FIGS. 5–12, the inventive feeding spoon connects to a tube, or other compressible reservoir, by means of a push-on connector. Referring first to FIGS. 5 and 6, spoon 100 is similar in appearance to the spoon previously described, and comprises: an elliptical rim or edge 102 at the top of a concave bowl 104; a short longitudinal handle 106 which terminates in a frustro-conical portion 108 having slots 110, an opening 112, and latching members 114 (best seen in FIG. 10), constituting a first connector 118. A longitudinal passageway 116 communicates opening 112 to spoon bowl 104.

Figure 7:
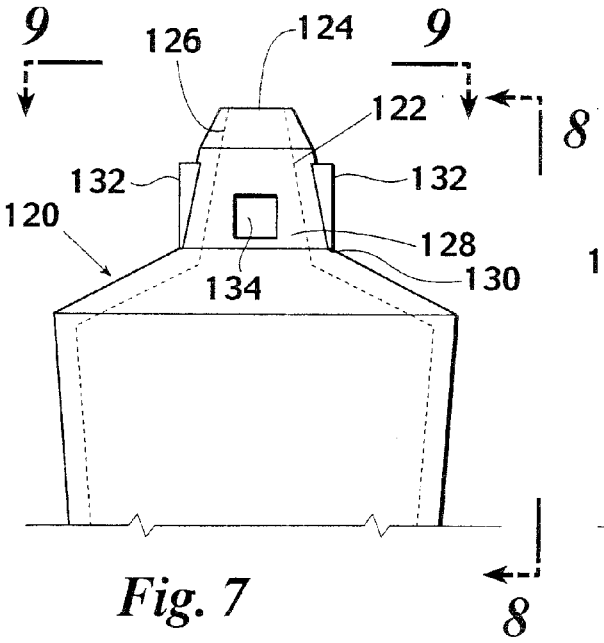
FIG. 7 is an elevation view of an end of a tube configured to receive the spoon of FIG. 5.
Figure 8:
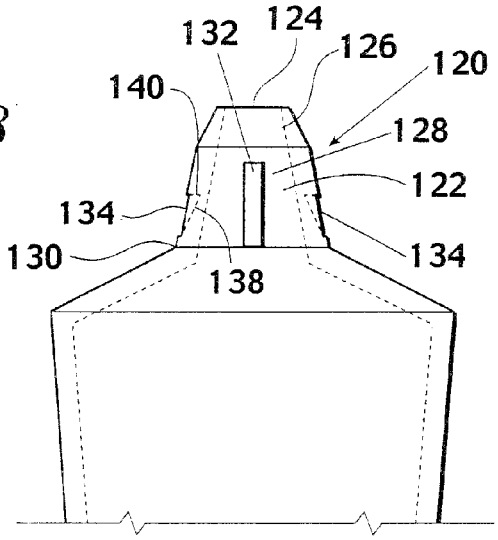
FIG. 8 is an elevation view of the tube as seen from perspective 8—8 of FIG. 7.
Figure 9:
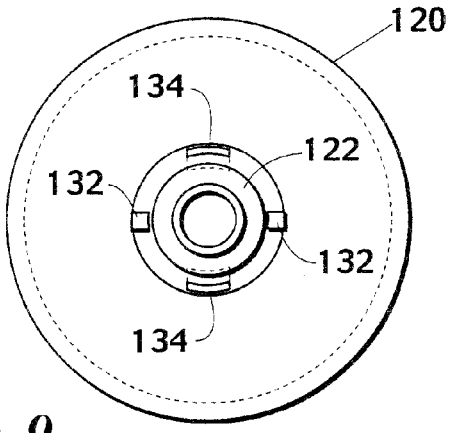
FIG. 9 is an end view of the tube as seen from perspective 9—9 of FIG. 7.
Figure 10:
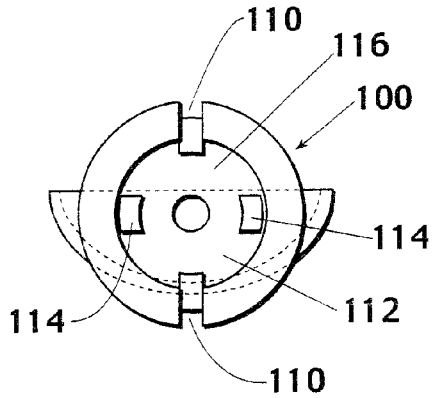
FIG. 10 is an end view of the spoon showing the connector as seen from perspective 10—10 of FIG. 6.

Turning now to FIGS. 7–9, spoon 100 (FIG. 5) is connectable to a compressible reservoir such as tube 120. Tube 120 includes a connector 122 which interfaces connector 118 (FIG. 5) of spoon 100. Connector 122 preferably has a shape which is substantially cylindrical, having inward tapered portion 126 at distal end 124 and a slight inward taper on main body portion 128 from base 130 to tapered portion 126, however, most preferably, connector 122 is formed to be received in opening 112 of passageway 118 (FIG. 5). Connector 122 also includes tabs 132 extending outward from main body 128 and cavities 134 located in main body 128.

Figure 11:
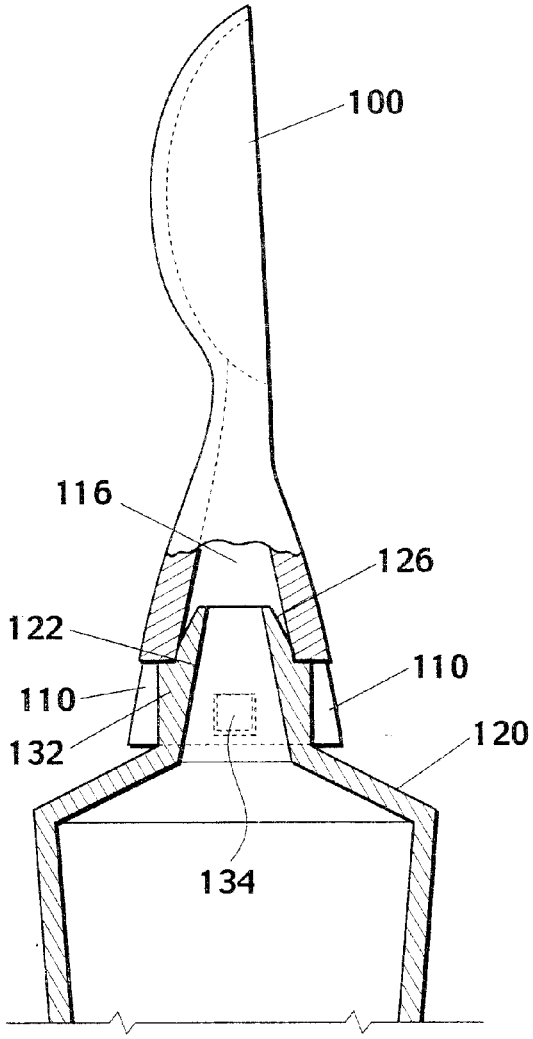
FIG. 11 is a side cross section view of the spoon of FIG. 5 attached to the tube of FIG. 7.
Figure 12:
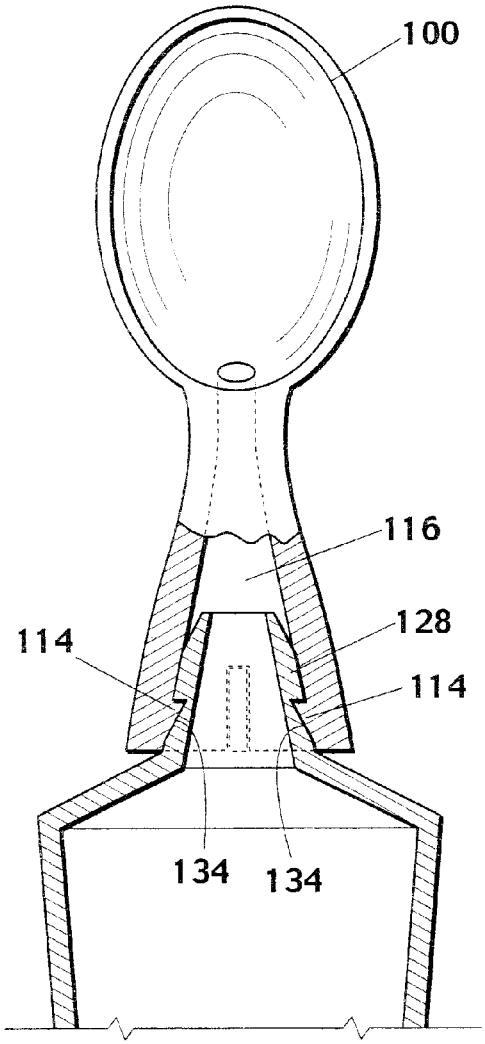
FIG. 12 is a top cross section view of the spoon of FIG. 5 attached to the tube of FIG. 7.

Referring net to FIGS. 11 and 12, to connect spoon 100 to tube 120, connector 122 is simply inserted into opening 112 (FIG. 10) with tabs 132 aligned with slots 110. Tapered portion 126 facilitates alignment between the two parts. The spoon 100 and tube 120 are pushed towards each other until latching members 114 snap into cavities 134. With further reference to FIG. 8, it should be noted that each cavity 134 is formed to have an inner wall 138 and a top wall 140. Inner wall 138 tapers outward from top wall 140 until, at its lower end, inner wall 138 intersects the wall of main body 128. Top wall 140 slopes slightly downward from inner wall 138 to the wall of main body 128 giving cavity 134 a barb-like appearance. The shape of latching member 114 is the inverse of cavity 134 having a top surface 150 (FIG. 6) which slopes slightly upward from the wall of cavity 116 so that, when spoon 100 is snapped onto tube 120 latching member 114 securely locks into cavity 134.

It should also be noted that, with the spoon 100 latched to tube 120, it is most preferable that there is sufficient contact between main body 128 and the wall of cavity 116 to prevent leakage when food is dispensed from the tube 120.

In many instances it may be ideal for the spoon to latch permanently to the tube so that, once the food is dispensed, the tube and spoon are disposed of as a unit. In the preferred embodiment, latching member 114 and cavity 134 latch in such a manner. As will be apparent to those skilled in the art, the shape of latching member 114, and the matching shape of cavity 134, may be easily modified to adjust the degree of force required to remove spoon 100 from tube 120.

As will also be apparent to those skilled in the art, a number of variations are possible which are still within the scope of the present invention. By way of example and not limitation, such modifications may include: changing the shape or appearance of the spoon portion; using a connector having an engaging means other than those described above, such as a quarter-turn fastener, a flange and garter spring connector, etc.; a squeeze bottle in lieu of the tube or syringe; and the like.

As will be further apparent to those skilled in the art, various adapters could be formed to interface a spoon and a tube having different styles of connectors. For example, an adapter could be formed to adapt spoon 100 to a tube having a threaded connector, the adapter having the connector of tube 120 at one end, and a female threaded connector similar to that found on spoon 10, at the other end. Conversely, an adapter could also be formed having a female connector similar to connector 118 at a first end, and a male threaded connector at the opposite end to interface spoon 10.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A disposable feeding system comprising:

a spoon having:

a body having a concave feeding portion; and a first connector in fluid communication with said concave feeding portion, said first connector comprising:

a first connector body;

an opening defining a connector cavity in said first connector body; and a latching member projecting from said first connector body into said connector cavity; and a compressible tube adapted to contain a predetermined quantity of food therein, said compressible tube including a second connector engageable with said first connector by applying longitudinal pressure between said spoon and said compressible tube, said second connector comprising:

a second connector body receivable in said connector cavity; and a latching cavity in said second connector body, said latching member interacting with said latching cavity to secure said first connector with said second connector when said first and second connectors are engaged.

2. A disposable feeding system as set forth in claim 1 wherein said latching member and said latching cavity interact such that, after said first connector is engaged with said second connector, said first and second connectors cannot be disengaged.

3. A disposable feeding system as set forth in claim 1 wherein said first connector further comprises a slot in said first connector body and said second connector body further comprises a tab for interacting with said slot such that said spoon is constrained to a predetermined orientation relative to said tube when said first and second connectors are engaged.

* * * * *